United States Patent [19]

Grilliot et al.

[11] Patent Number: 4,817,211

[45] Date of Patent: Apr. 4, 1989

[54] FIREFIGHTER'S TROUSERS CAPABLE OF RECEIVING A BOOTED FOOT

[76] Inventors: William L. Grilliot; Mary I. Grilliot, both of 1986 Home Ave., Dayton, Ohio 45417

[21] Appl. No.: 182,399

[22] Filed: Apr. 18, 1988

[51] Int. Cl.[4] ..... A41D 1/06

[52] U.S. Cl. ..... 2/227; 2/81; 2/272

[58] Field of Search ..... 2/22, 23, 24, 81, 227, 2/272

[56] References Cited

U.S. PATENT DOCUMENTS

| | | | |
|---|---|---|---|
| 2,317,768 | 11/1939 | Holland | 2/227 |
| 2,349,974 | 8/1942 | McMasters | 2/227 |
| 2,714,720 | 7/1954 | Turner | 2/227 |
| 2,967,308 | 3/1958 | Freese | 2/227 |
| 3,115,641 | 12/1961 | Rea | 2/227 |
| 3,925,823 | 12/1975 | Kupferman | 2/81 |

*Primary Examiner*—Werner H. Schroeder
*Assistant Examiner*—D. Biefeld
*Attorney, Agent, or Firm*—Jacox & Meckstroth

[57] ABSTRACT

Firefighter's trousers which can be donned by a firefighter wearing boots or the like. The trousers have a pair of leg portions. Each of the leg portions has sections which are separated before the trousers are donned. Then after the trousers are donned the sections are attached together around the boots and legs of the firefighter.

6 Claims, 1 Drawing Sheet

FIREFIGHTER'S TROUSERS CAPABLE OF RECEIVING A BOOTED FOOT

BACKGROUND OF THE INVENTION

In the past firefighters have used step-in firefighting boots. These step-in boots have been stored with the firefighter's trousers which were pushed down around the boots. When a firefighter received an alarm, the firefighter removed shoes which were worn at the fire station. Then, in stocking covered feet, the firefighter stepped into the trousers and into step-in type boots. Then the trousers were pulled up to the waist and fastened around the waist.

This was a very efficient and quick way to don firefighter's boots and trousers. However, step-in boots offer little ankle support. They have to be flexible and roomy in the ankle area to permit easy step-in action. Fire departments were soon observing an unacceptable frequency of ankle injuries which occurred during firefighting. As a result, non-step-in lace-up type ankle support firefighter boots were introduced.

Firefighters began to wear the ankle support lace-up type of boots in the fire station so that they would be ready to respond when a fire alarm occurred.

Firefighter's concurrently also were required to respond in firefighting coats and trousers, as a result of new firefighting regulations. Previously, some firefighters used coats alone with conventional trousers. Fire departments wearing the ankle support boots found they could not get their booted foot effectively into the trousers legs of firefighting trousers.

A firefighter wearing lace-up boots would take too much time to don the boots after an alarm, due to the fact that the ankle support lace-up boots required unlacing and removal before donning trousers and then required donning and lacing the boots. Fire departments are judged on the rate of response to an alarm. So rate of response is a very critical consideration. Therefore, a choice had to be made between non-ankle support slip-on boots (which permit too many injuries) or an excessive response time (removal of ankle support boots and putting on the trousers and then replacing the boots).

As a solution to the problem, wide trouser legs were considered. However, it was not practical to merely widen the leg portion of firefighter trousers in order to permit freedom of access of a booted foot. A wide trouser leg would interfere with natural walking and crawling movements of a firefighter. Such wide trouser legs would therefore increase the stress occurring in a firefighter during firefighting activity. It is known that stress is the major cause of death and injury of firefighters, and attempts must be made to reduce stress in a firefighter.

Additionally, any solution to the problem must provide a fail-safe mechanism in the garments. A fail safe mechanism is one which provides adequate protection of a firefighter even though the firefighter may not have the opportunity or time available to completely finish donning the firefighter's garments prior to firefighting. fighting.

Therefore, the problem solved in this invention is the creation of trousers which allow easy donning even by a firefighter who wears boots, and yet the trousers are not unnecessarily bulky, heavy or restrictive of movement.

Therefore, three problems are solved in this invention. Firefighter's trousers are provided which can be donned while the firefighter is wearing boots. There is ease of access into the trousers while also the trousers are free from bulkiness. Furthermore, trousers of this invention are a portion of a system in which adequate protection of the firefighter is maintained and preserved even though the firefighter does not have the time or opportunity to operate all of the fastener or closure elements in the garments prior to firefighting.

It is an object of this invention to provide trousers for a firefighter which can be easily and readily donned while the firefighter is wearing boots. Thus, the firefighter does not need to remove boots which are being worn in the fire station. Thus, a firefighter can easily and quickly don the trousers and be prepared for firefighting.

Other objects and advantages of the firefighter's garment of this invention reside in the construction of parts, the combination thereof, the method of production and the mode of use, as will become more apparent from the following description.

SUMMARY OF THE INVENTION

Firefighter's trousers of this invention include a torso portion and leg portions. Each of these portions includes an outer shell and an inner layer or inner liner of material. In this invention the lower part of the outer shell of each leg portion is separated into two sections to form an elongate opening along most of the length of the leg portion. The elongate opening starts at the extreme lower ed of the leg portion and extends upwardly along a major part of the length of the leg portion. Means are provided for easily and readily attaching the two sections together and for releasing the two sections. A slide fastener or some other suitable closure means is employed to attach together the two sections of each leg portion.

Thus, when the two sections of the leg portions are separated, a booted foot can move easily into each leg portion of the trousers. After the booted foot moves through the leg portion and the trousers are donned, the two sections of each leg portion are attached together around the boot and around the lower part of the leg of the firefighter. The inner layer or inner liner in each leg portion is tubular and of a dimension to readily receive the booted foot. The inner liner is very flexible and assumes a multiplicity of small folds when the two sections of the outer shell are attached together around the boot. This donning operation can be easily and readily performed. Thus, the firefighter can quickly prepare for firefighting.

DETAILED DESCRIPTION OF THE INVENTION

Figure 1:
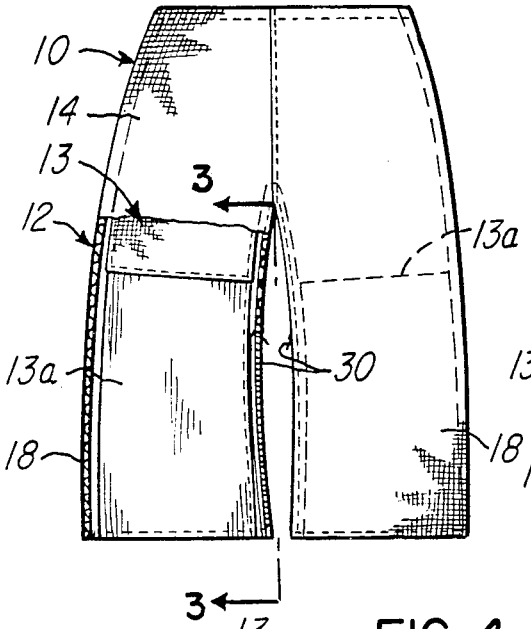
FIG. 1 is a rear elevational view, with parts broken away and shown in section, illustrating firefighter's trousers made according to this invention. In this view the sections of the leg portions of the trousers are detached one from the other, and the trousers are in condition for donning.
Figure 2:
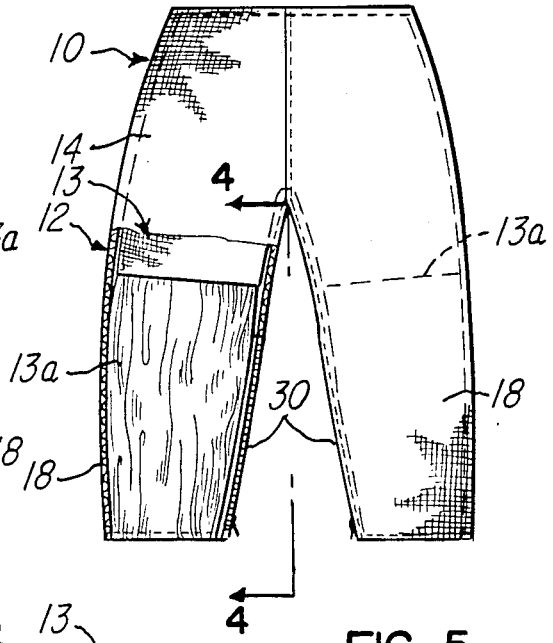
FIG. 2 is a rear elevational view, with parts broken away and shown in section, illustrating the leg portions of the trousers after the sections of the leg portions are attached together.
Figure 3:
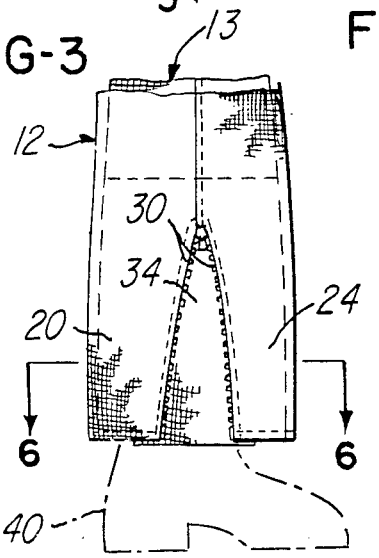
FIG. 3 is an elevational view taken substantially on line 3—3 of FIG. 1.
Figure 6:
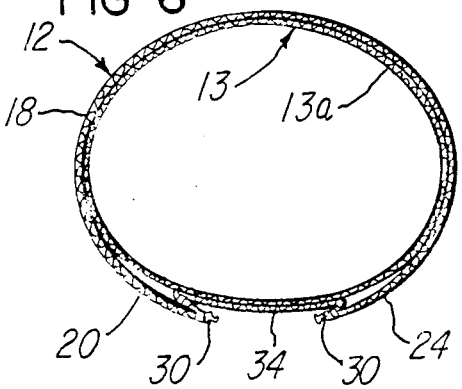
FIG. 6 is an enlarged sectional view taken substantially on line 6—6 of FIG. 3.

FIGS. 1 and 2 illustrate firefighter's trousers which are constructed in accordance with this invention. The trousers have an outer shell 12 and an inner liner 13. The trousers have a torso portion 14 and leg portions 18. The outer shell 12 of each of the leg portions 18 has a part 20 and a part 24, as shown in FIGS. 3 and 6. The parts 20 and 24 extend upwardly and downwardly along the leg portions 18. The parts 20 and 24 are provided with a closure element, herein shown as a slide fastener 30 which is attached to the parts 20 and 24. Also, attached to the parts 20 and 24 and extending therebetween is a flexible flap 34.

Figure 4:
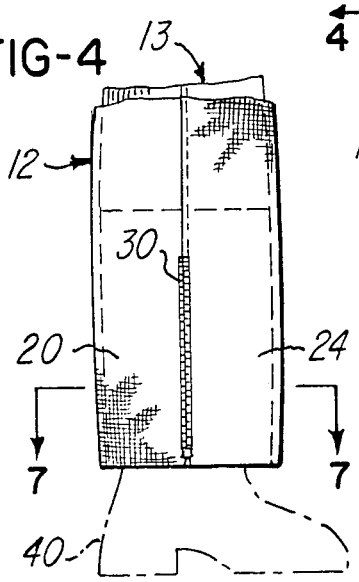
FIG. 4 is an elevational view taken substantially on line 4—4 of FIG. 2.

The trousers are adapted to be donned while the firefighter is wearing boots or the like, such as a boot 40 shown in FIGS. 3 and 4. Therefore, the firefighter is not required to remove the boots 40 before donning the trousers.

Figure 5:
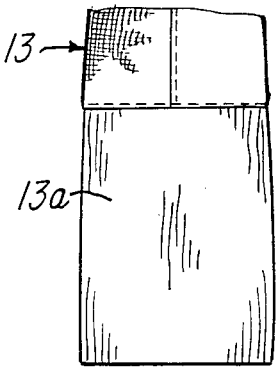
FIG. 5 is an elevational view showing the inner liner part of a trouser leg portion.

The inner liner 13 within each trouser leg portion 18 has a lower region 13*a* which is tubular and which is relatively thin and very flexible, as illustrated in FIG. 5. Due to the fact that the lower region 13*a* of each leg portion 18 covers a part of the boot 40, the lower region 13*a* may have lesser insulation qualities than other parts of the inner liner 13.

Figure 7:
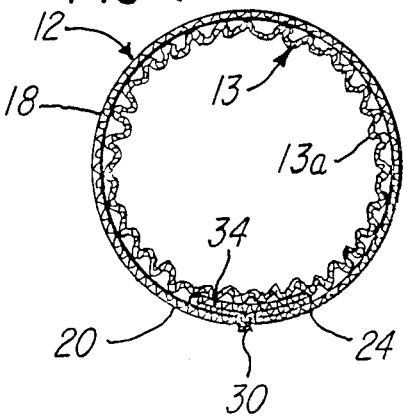
FIG. 7 is an enlarged sectional view taken substantially on line 7—7 of FIG. 4.

When the parts 20 and 24 of the trouser leg portions 18 are separated, as illustrated in FIGS. 3 and 6, the trousers are easily donned by a firefighter wearing boots 40. After the legs of the firefighter with boots 40 are moved into the trouser leg portions 18, the slide fastener 30 is operated to attach together the parts 20 and 24 of the leg portions 18 of the outer shell 12, as illustrated in FIGS. 4 and 7. As shown, the lower region 13*a* of the inner liner 13 in the leg portions 18 is very flexible. Therefore the lower region 13*a* assumes a multiplicity of small folds and is readily enclosed within the outer shell 12 as the parts 20 and 24 of the outer shell 12 are attached together by the slide fastener 30, as illustrated in FIG. 7.

Thus, a firefighter can quickly and easily don the trousers, and then, by means of the slide fastener 30, the lower parts 20 and 24 are attached together around the boots 40 and legs of the firefighter.

Due to the fact that the lower parts of the leg portions 18 have both the inner liner 13 and the outer shell 12, the lower parts of the legs of a firefighter wearing the trousers are protected, even though the firefighter may not have the opportunity to operate the slide fastener 30 to attach the parts 20 and 24 together. Also, when the firefighter is in a cleaning operation or the like and is not fighting a fire, the parts 20 and 24 may be separated, and effective ventilation of the firefighter's legs is possible.

Although the preferred embodiment of the firefighter's trousers of this invention has been described, it will be understood that within the purview of this invention various changes may be made in the form, details, proportion and arrangement of parts, the combination thereof, and the mode of use, which generally stated consist in a structure or method within the scope of the appended claims.

The invention having thus been described, the following is claimed:

1. A firefighter's trousers which are easily donned by a firefighter who wears boots, in which each of the boots has a foot part and a leg part, the foot part and the leg part of each of the boots having given dimensions, the trousers comprising an outer shell of abrasion resistant material and an inner liner of insulation material, the inner liner being covered by the outer shell, the outer shell having a torso part and a pair of leg parts, the inner liner having a torso part and a pair of leg parts, each of the leg parts of the outer shell and each of a the leg parts of the inner liner of the trousers having a lower portion which is adapted to cover the leg part of a firefighter's boot, the torso part of the inner liner being of material of a given weight per unit area and having a given flexibility and having given insulation qualities, the lower portion of the inner liner of each of the leg parts of the trousers being of a lighter weight material than the material of the torso part of the inner liner and having a flexibility greater than the given flexibility of the torso part of the inner liner and having lesser insulation qualities than the given insulation qualities of the torso part, the lower portion of each of the leg parts of the inner liner being tubular and forming a tubular passage significantly greater in dimensions than the given dimensions of the foot part and leg part of the boots, the lower portion of the leg parts of the outer shell freely encompassing the lower portion of the respective leg part of the inner liner whereby the boots move easily through the lower leg parts of the trousers as a firefighter dons the trousers while wearing the boots, the lower portion of each of the leg parts of the outer shell having a bottom edge, the lower portion of each of the leg parts of the inner liner having a bottom edge, the bottom edge of the lower portion of the leg parts of the outer shell and the bottom edge of the leg parts of the inner liner being adapted to be immediately above the foot parts of the boots as the boots and trousers are worn by the firefighter, wherein the lower portion of the leg parts of the inner liner and the lower portion of the leg parts of the outer shell cover the leg parts of the boots, and whereby the legs of the firefighter are adequately protected while permitting ease of donning of the trousers while the firefighter wears boots and while permitting the trousers to have minimum weight.

2. The firefighter's trousers of claim 10 in which the lower portion of each of the leg parts of the outer shell includes two separate sections which extend upwardly from the bottom edge, fastener means carried by the sections of the lower portion of each of the leg parts of the outer shell for attaching together the two sections of the lower portion of the leg parts of the outer shell, whereby the sections of the lower portion of the leg portions of the outer shell are attached together after the trousers are donned, the lower portion of the leg parts of the outer shell forming a tubular passage having a dimension only slightly greater than the given dimension of the leg part of the boots when the sections of the lower portion of the leg parts of the outer shell are attached together, whereby the lower portion of the leg parts of the outer shell closely enclose the lower portion of the leg parts of the inner liner, and whereby folds are formed in the lower portion of the leg parts of the inner liner as the lower portion of the leg parts of the inner liner closely covers the leg part of the boots.

3. The firefighter's trousers of claim 1 in which the lower portion of each of the leg parts of the outer shell includes two separate sections which extend upwardly from the bottom edge, fastener means carried by the sections of the lower portion of each of the leg parts of the outer shell for attaching together the two sections of the lower portion of the leg parts of the outer shell, whereby the sections of the lower portion of the leg parts of the outer shell are attached together after the trousers are donned, the lower portion of the leg parts of the outer shell forming a tubular passage having a dimension only slightly greater than the given dimension of the leg part of the boots when the sections of the lower portion of the leg parts of the outer shell are attached together, whereby the lower portion of the leg parts of the outer shell closely enclose the lower portion of the leg parts of the inner liner and force the lower portion of the leg parts of the inner liner into folds as the lower portion of the leg parts of the inner liner closely covers the leg part of the boots, the trousers including a flexible flap attached to both of the sections of the lower portion of each of the leg parts of the outer shell, the flexible flap extending between the sections.

4. The firefigher's trousers of claim 1 in which the lower portion of each of the leg parts of the outer shell includes two separate sections which are attachable together and in which the lower portion of the leg parts of the outer shell has a peiphery which is significantly less in length than the length of the periphery of the lower portion of the leg part of the inner liner when the two sections of the leg parts of the outer shell are attached together, whereby the lower portion of each of the leg parts of the inner liner has folds therein as the lower portion of the leg part of the inner liner encompasses the leg part of a boot and as the two sections of the outer shell are attached together and encompass the lower portion of the leg part of the inner liner.

5. Firefighter's trousers for a firefighter who wears boots, each of the boots having a foot portion and a leg portion, the trousers comprising an outer shell which is constructed of abrasion resistant material, and an inner liner of thermal insulation material, the outer shell covering the inner liner, the outer shell having a torso part and a pair of leg parts, the inner liner having a torso part and a pair of leg parts, the torso part of the inner liner being of a thermal insulation material which has a given flexibility and a given thermal insulation quality, each of the leg parts of the inner liner having a lower portion which is of a thermal insulation quality less than the given thermal insulation quality of the torso part of the inner liner, the lower portion of each of the leg parts of the inner liner having a flexibility greater than the given flexibility of the torso part of the inner liner, the lower portion of each of the leg parts of the inner liner being adapted to cover the leg part of a boot worn by the firefighter, the lower portion of each of the leg parts of the outer shell covering the lower portion of the respective leg part of the inner liner, the lower portion of each of the leg parts of the inner liner being of a dimension to permit free movement of the firefighter's boot therethrough as the firefighter dons the trousers, the lower portion of each of the leg parts of the outer shell being of a dimension to permit movement of the firefighter's boot through the lower portion of the respective leg part of the inner liner as the lower portion of the leg part of the outer shell covers the lower portion of the leg part of the inner liner, whereby the leg part of the boot and the lower portion of the leg part of the inner liner and the lower portion of the leg part of the outer shell adequately protect the lower leg portions of the firefighter, while permitting the firefighter to don the trousers while wearing the boots.

6. The firefighter's trousers of claim 5 in which the lower portion of each leg part of the outer shell comprises a plurality of sections which are separated as the trousers are donned and which include fastener means for fastening the sections together after the trousers are donned, whereby the lower portion of the inner liner of each leg part is closely encompassed by the lower portion of the leg part of the outer shell when the fastener means fasten the sections together.

* * * * *

UNITED STATES PATENT AND TRADEMARK OFFICE

CERTIFICATE OF CORRECTION

PATENT NO. : 4,817,211

DATED : April 4, 1989

INVENTOR(S) : William L. and Mary I. Grilliot

It is certified that error appears in the above-indentified patent and that said Letters Patent is hereby corrected as shown below:

Column 4, line 47, change "10" to "1".

Column 5, line 26, change "peiphery" to "periphery".

Signed and Sealed this

Twenty-third Day of November, 1993

Bruce Lehman

*Attest:*

BRUCE LEHMAN

*Attesting Officer*

*Commissioner of Patents and Trademarks*